US006035810A

United States Patent [19]

Movassaghi

[11] Patent Number: 6,035,810

[45] **Date of Patent: *Mar. 14, 2000**

[54] PULSE COMBUSTOR AND BOILER FOR SAME

[75] Inventor: Mehrzad Movassaghi, Vancouver, Canada

[73] Assignee: Powertech Industries Inc., West Vancouver, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 09/063,443

[22] Filed: Apr. 21, 1998

Related U.S. Application Data

[63] Continuation-in-part of application No. 08/563,917, Nov. 29, 1995, abandoned.

[51] Int. Cl.[7] ..... F23C 11/04

[52] U.S. Cl. ..... 122/24; 431/1; 431/12; 431/75; 431/76; 431/89; 431/90; 431/266

[58] Field of Search ..... 431/1, 12, 78, 431/76, 75, 89, 90, 266; 122/24; 126/91 A

[56] References Cited

U.S. PATENT DOCUMENTS

| | | | |
|---|---|---|---|
| 4,474,548 | 10/1984 | Miyanaka et al. | 431/1 |
| 4,750,452 | 6/1988 | Trihey | 122/24 |
| 4,968,244 | 11/1990 | Movassaghi . | |
| 5,118,281 | 6/1992 | Bramlette et al. | 431/1 |
| 5,386,815 | 2/1995 | Ejiri et al. | 431/1 |

FOREIGN PATENT DOCUMENTS

| | | |
|---|---|---|
| 0 317 178 | 5/1989 | European Pat. Off. . |
| 0 532 339 | 3/1993 | European Pat. Off. . |
| 58-085 016 | 5/1983 | Japan . |
| 60-029 516 | 2/1985 | Japan . |

*Primary Examiner*—Carl D. Price
*Attorney, Agent, or Firm*—Hall, Priddy & Myers

[57] ABSTRACT

A boiler having a combustor for combusting an air/gas fuel mixture, the combustor including a heat exchanger which conducts coolant therethrough surrounding the combustion chamber and a fan coupled to an air line provides a flow rate of air in the air line. A gas line is coupled at one end to a source of gas and at another end to the air line so as to produce a mixture of gas and air. Means for measuring a property of the air/gas fuel mixture characteristic of its combustibility are utilized. A valve coupled to said gas line is operative to control a flow rate of gas in response to a control signal from the means for measuring. A temperature sensor takes a temperature measurement of the coolant after passing through the heat exchanger and transmits the temperature measurement to the speed control unit. The speed control unit slows down the speed of the fan when the coolant temperature approaches a preset limit.

16 Claims, 7 Drawing Sheets

PULSE COMBUSTOR AND BOILER FOR SAME

RELATED APPLICATIONS

The present application is a continuation-in-part of patent application entitled "Pulse Combustor And Boiler For Same", application Ser. No. 08/563,917, filed on Nov. 29, 1995, now abandoned.

FIELD

The present invention relates to a pulse combustor and a boiler which employs the pulse combustor.

BACKGROUND

A pulse combustor is a device in which a mixture of air and fuel is initially ignited by, for example, a ignition rod. The ignited gases expand rapidly with an associated rapid increase in pressure and temperature. A resultant pressure wave travels down the device expelling the burnt gases out of an exhaust region. Heat exchange occurs at the walls of the device cooling the gases and enhancing the pressure drop occurring after passage of the pressure wave. This pressure drop due to expansion of the gases combined with the cooling caused by heat exchange at the walls causes new gases to be drawn into the combustion chamber. At the same time the flow in the exhaust region reverses and compresses the new air and gas mixture and with the temperature in the combustion chamber still being high ignition occurs once again.

U.S. Pat. No. 4,968,244 issued to the Inventor herein, Mehrzad Movassaghi, describes a pulse combustor with a radial exhaust chamber and a carburetor coupled to the combustion chamber for injecting a pre-determined distribution of fuel mixture into the combustion chamber. The design of the casing of the exhaust chamber comprises an inside disc and an outside disc juxtaposed thereto with an inside disc and outside disc located on each side of the combustion chamber. The exhaust chamber has a spiral groove in the inside disc which is covered by the outside plate forming a coolant passageway. The usage of a disc and plate bonded together with a spiral groove in the disc makes construction difficult and expensive. Moreover, the rapid heating and cooling stresses the bonding between the disc and plate making the device susceptible to coolant leaks. Finally, the somewhat complex design of the carburetor adds to the expense of the device.

In known heat generation systems in either a boiler or furnace, control is achieved by turning the heat generating system on and off. When the temperature exceeds a preset threshold, the system is turned off and allowed to cool. Similarly, once cooling has lowered the temperature below a threshold, the system is restarted. Obviously, heating above the threshold on heating up and cooling below the threshold on cooling down are inherent in such a control system. The constant cycling between the temperatures at shut-off and turn-on contribute to high thermal stresses which reduce the life expectancy of the material.

In addition, known heat generation systems in either a boiler or furnace optimize the combustion reaction by controlling the gas flow in relation to the air flow. The degree of optimization of the reaction in these systems depends on the accuracy of the means for measuring the flow of gas and air and the means for controlling the flow of gas. Also, in these systems, the reactant of the combustion reaction, oxygen, is not measured directly. Thus, variations in the amount of oxygen in the air due to ambient air quality or altitude which would affect the reaction rate are ignored.

European. Pat. No. 0 317 178 discloses a simple boiler having a combustion chamber adjacent a fluid chamber from which it receives heat. A temperature control system with two temperature sensors whose temperature measurements are transmitted to an electrical control box is disclosed. A motor speed controller linked to the electrical control box responds to an increasing temperature differential by causing the motor of a fan to speed up thereby increasing the amount of air in the air chamber. An air pressure sensor tube which opens into the chamber senses the air pressure and actuates a diaphragm which changes the gas flow by means of a gas regulator valve accordingly. The air chamber also contains a flame ring at one end which opens onto the combustion chamber. There is no measurement of the gas flow pressure. Thus, the means for controlling the gas to air fuel ratio is relatively simple. Also, the gas line introduces the gas into this flame ring and the gas and air are mixed at the flame ring instead of a mixing chamber.

In Japanese. Pat. No. 58 085 016, a boiler has an air sensor and a gas sensor to sense the amount of air and gas supplied respectively. The amount of gas supplied is changed in response to the amount of air supplied. The speed of the fan which determines the amount of air supplied is controlled by signals from a temperature sensor coupled to the heat exchanger. The signals from the air sensor and the gas sensor are sent to a gas flow rate control unit which controls the closing and opening of the a control valve in the gas line. There is also premixing of gas and air before combustion, however, the premixing occurs in the air chamber where the air sensor is located. As the gas line emits gas into the air chamber, the measurement of air pressure may be skewed.

The efficiency of the combustion in systems which establish the air-gas ratio from a measurement of the air pressure differential across an aperture and an adjustment of the gas flow accordingly, or some other equivalent method, are affected by factors such as efficiency of mixing of the gas and air, barometric pressure, extremes of temperature, and the presence of gas in the air flow measurement. None of the foregoing systems address solutions for these inaccuracies.

Accordingly, it is an object of the invention to provide a less costly, more efficient and reliable radial pulse combustor than is presently known. It is a further object of the invention to provide a boiler which utilizes the aforesaid pulse combustor and in which control of the output temperature is applied continuously. It is further an object of the invention to provide a pulse combustor with maximum rates of combustion.

SUMMARY OF THE INVENTION

According to the invention there is provided a combustor for combusting an air/gas fuel mixture having a heat exchanger which conducts coolant therethrough and a fan coupled to an air line to provide a flow rate of air in the air line. A speed control unit is coupled to the fan to control the speed thereof. A gas line is coupled at one end to a source of gas and at another end to the air line so as to produce a mixture of gas and air. Means are provided for measuring a property of the air/gas fuel mixture characteristic of its combustibility. A valve coupled to said gas line is operative to control a flow rate of gas in response to a control signal from the means for measuring and a temperature sensor takes a temperature measurement of the coolant after passing through the heat exchanger and transmitting the temperature measurement to the speed control unit. The speed control unit slows down the speed of the fan when the coolant temperature approaches a preset limit.

The means for measuring may be an oxygen sensor. The oxygen sensor may be located to measure the combustion gases after combustion of the fuel/air mixture.

The valve may be a magnetoelectric valve operative to control the flow rate of gas in said gas line in response to a control signal from the oxygen sensor.

The combustor may be of a type having a pair of disc-shaped spaced apart walls enclosing a central combustion chamber and an exhaust region between the walls which surrounds the combustion chamber and extends outwardly from the combustion chamber. The first and second spaced apart walls are each formed of hollow tubing wound in a spiral from the combustion chamber outwardly towards the exhaust region with windings of the spiral being adjacent and contiguous. A fuel line coupling at an inlet of said combustion chamber operates to couple to a fuel line and supply premixed fuel from the boiler. The tubing of each of the walls is adapted to conduct a heat exchange coolant.

The combustor may have a flame spreader hub on a side of the combustion chamber opposite an inlet thereto to prevent quenching of combustion in the combustion chamber.

A spark plug has a spark end which communicates with the combustion chamber.

A flame sensor is inserted through the burner hub into the combustion chamber.

The windings of the tubing are welded together so gas cannot leak out of the exhaust region of the combustor.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

DETAILED DESCRIPTION WITH REFERENCE TO THE DRAWINGS

Figure 1:
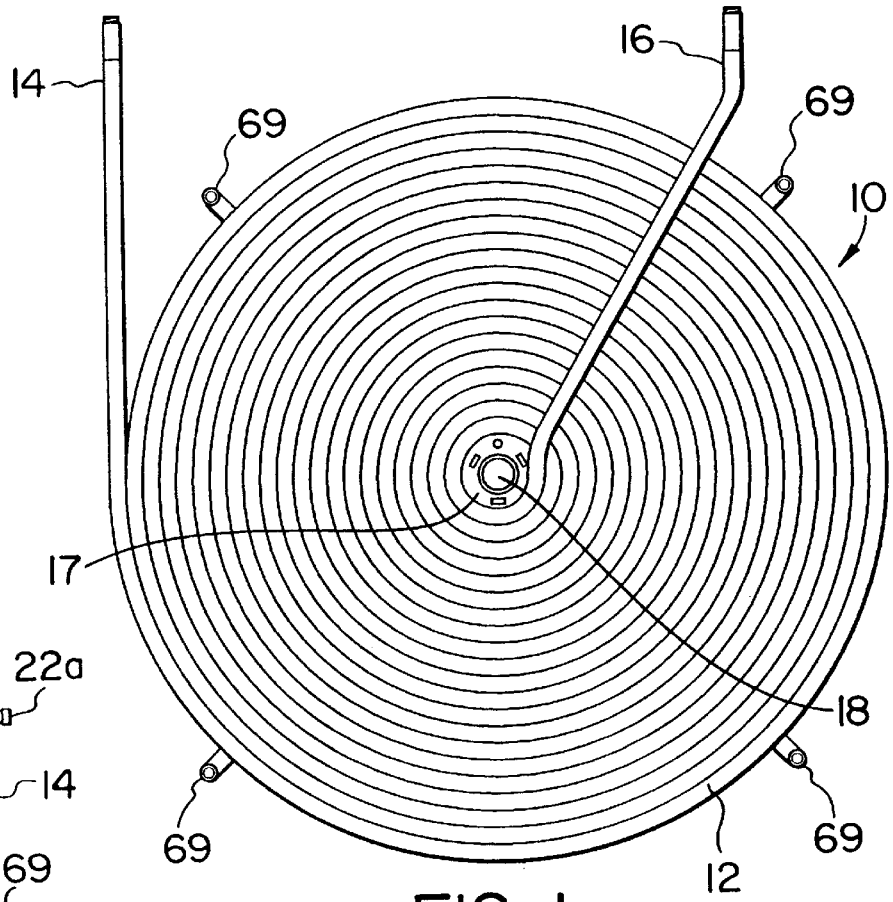
FIG. 1 is a front elevation view of the radial pulse combustor.
Figure 2:
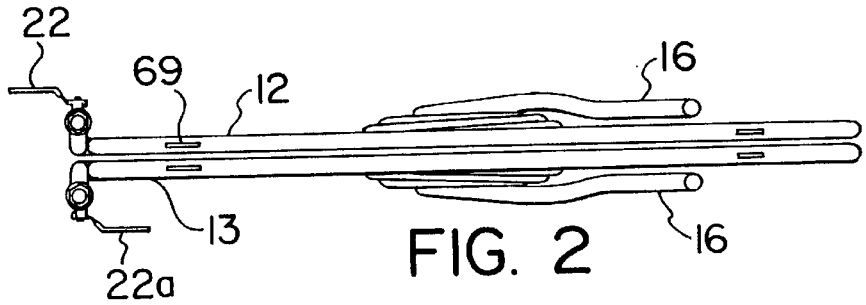
FIG. 2 is an elevation view of the radial pulse combustor showing the inlet and outlet coolant tubes.
Figure 3:
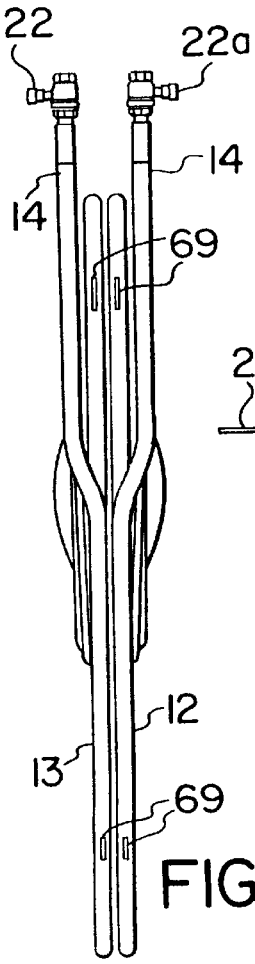
FIG. 3 is an elevation view of the radial pulse combustor showing the inlet coolant tubes.
Figure 4:
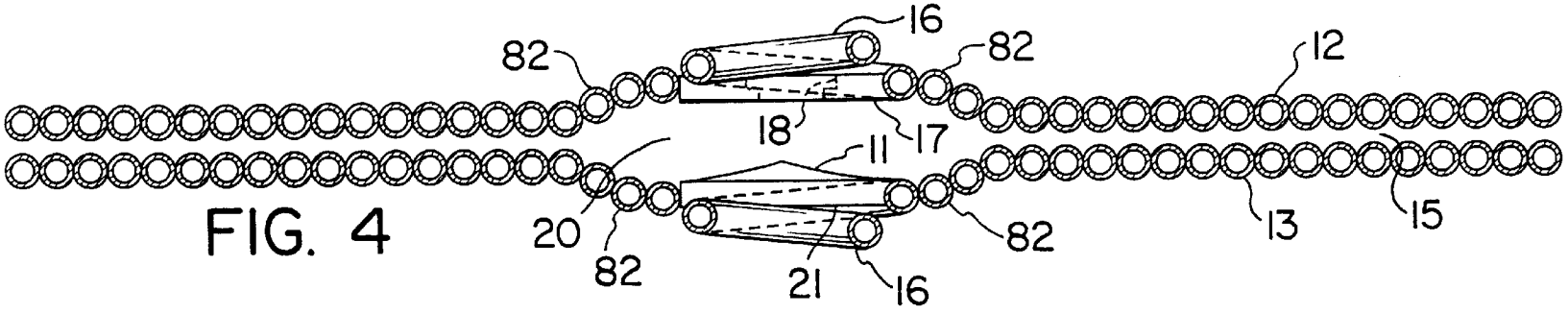
FIG. 4 is a section view of the pulse combustor in elevation showing the spacing between the walls of tubing.

Referring to FIGS. 1 to 4 there is shown the radial pulse combustor 10 which is formed by a pair of spaced apart walls 12 and 13 with each wall made of spiral coolant tubing spiraling outwardly from a central outlet tube 16 to an outer inlet tube 14. The coolant tubing is stainless steel. The walls 12 and 13 are welded to two central plates 17 and 21. A gas nozzle receptacle 18 is formed through the center of a circular plate 17 (see also FIG. 4) fitted into the center of wall 12 into a combustion chamber 20 bounded by plates 17 and 21 and a conical portion 82 of walls 12 and 13. Tabs 69 welded to the perimeter of each wall 12 and 13 of tubing to provide a means of mounting the combustor 10 and for spacing apart the walls 12 and 13 a predetermined distance. Between each set of tabs 69 there is inserted a spacer (not shown) which provides the required gap between the plates 12 and 13. An interior surface of plate 21 has a conical surface 11 that faces nozzle receptacle 18. Conical surface 11 disperses the flame outwardly through the combustion chamber 20. The volume 15 between the walls 12 and 13 is termed the tail pipe. Water enters each tube 14 of walls 12 and 13 at the perimeter and exits at the center through tube 16 to allow for a counter flow heat exchange process.

Shut off valves 22 and 22*a* allow manual closure of the flow into and out of the cooling tubing 14. The diameter of the combustor 10 is approximately 44.5 inches and is chosen so that the rarefaction waves that reach the perimeter of the tail pipe region 15 and return to the combustion chamber 20, reach the combustion chamber 20 at the precise time at which a new charge of air/gas mixture is drawn into the combustion chamber 20. The separation of the walls 12 and 13 is approximately 0.4 inches while in the combustion chamber 20 the sides are inclined at about 25 degrees to a plane passing through the tail pipe region parallel to the walls 12 and 13. The width of the combustion chamber 20 is approximately 2.34 inches while its diameter is approximately 12.5 inches.

Referring to FIGS. 5, 6, 8 and 11, the nozzle 19 has a lower portion 54 of reduced diameter which fits into a lower portion of receptacle 18. The nozzle interior has threads 28 at one end which register with the threads (not shown) of a male end of a reducer pipe 61 (see FIG. 11). Pipe 61 couples the nozzle 19 to a pipe 31. A threaded end cap 83 having a threaded opening to register with the threads of ignition rod 32 align the ignition rod 32 with the nozzle 19. A long insulating rod 26 extends from and forms a part of the ignition rod 32 into the nozzle 19. From the end of rod 26 an electrode 33 protrudes and is bent over into a hook shape at its end with its point flush with one of several radially spaced injection holes 35 that terminate in recess 24 to produce immediate combustion of the air/gas mixture. An annular interior projection 45 (see FIG. 5) is angled towards the end of nozzle 19.

Figure 7:
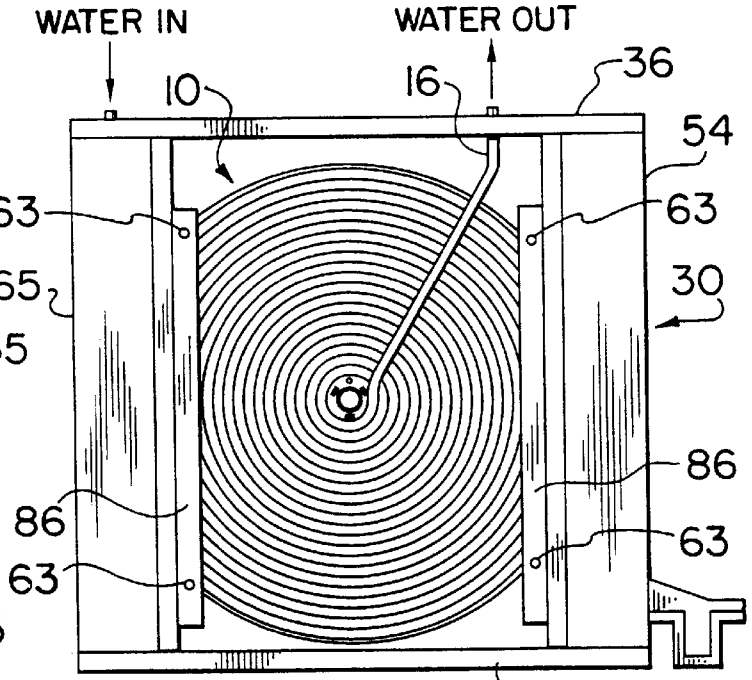
FIG. 7 is a front elevation view of a boiler assembly which incorporates the combustor with the front panel removed.
Figure 6:
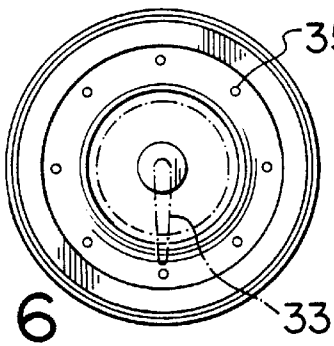
FIG. 6 is an end view of the nozzle.
Figure 5:
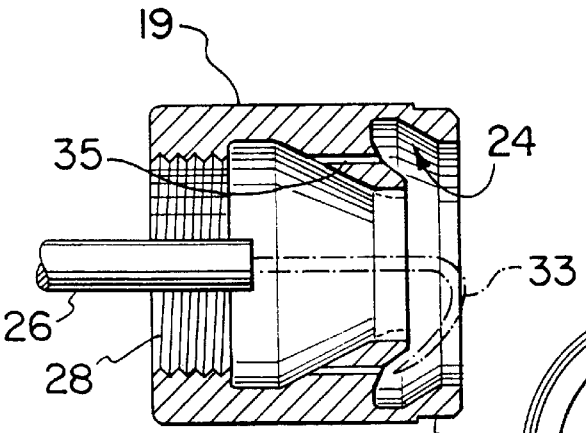
FIG. 5 is an elevation view in section of the nozzle.
Figure 8:
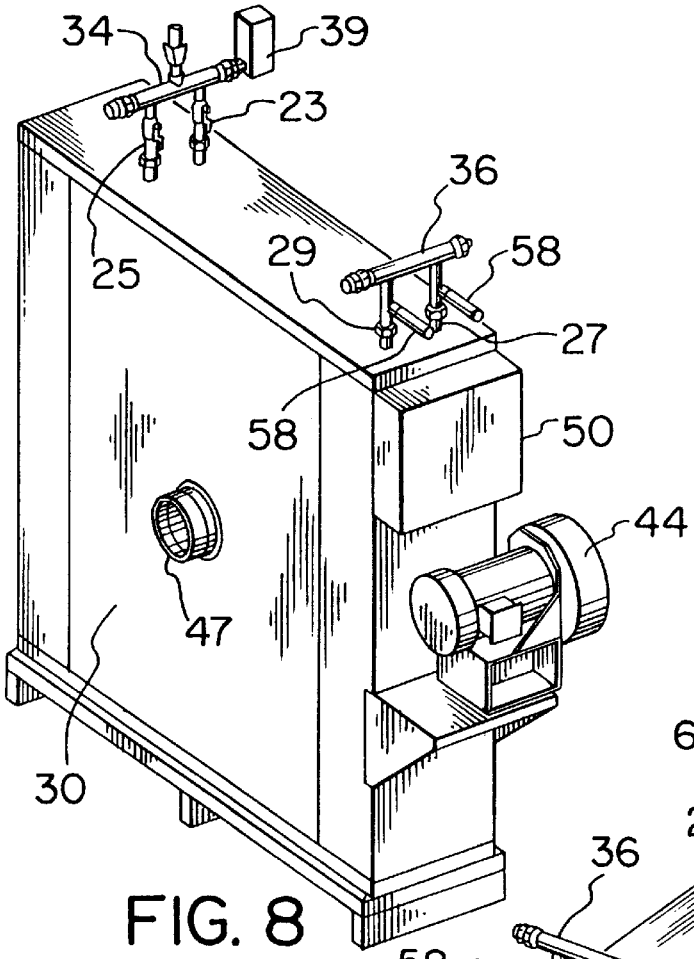
FIG. 8 is perspective view of the boiler showing coolant inlets and outlets and the fan.
Figure 11:
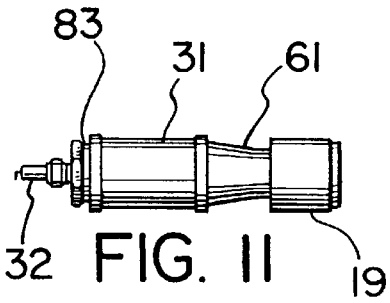
FIG. 11 is an elevation view of the nozzle assembly.
Figure 9:
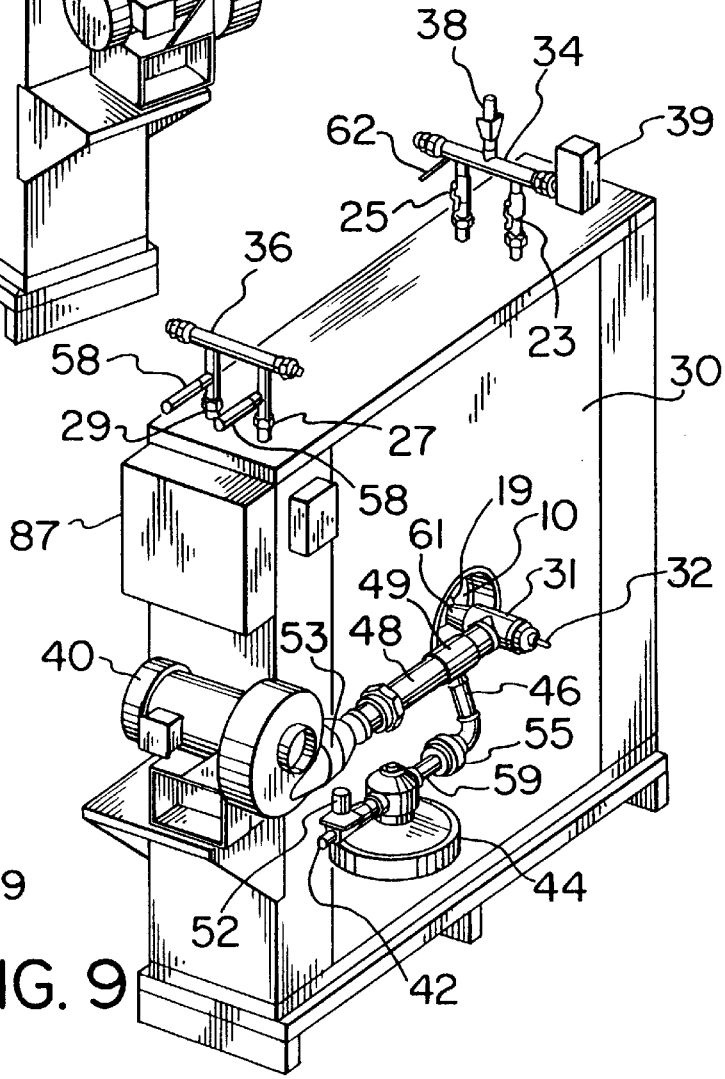
FIG. 9 is a second perspective of the boiler showing the mass flow regulator and the connection into the combustion chamber of the radial pulse combustor.

Referring to FIG. 7, the pulse combustor 10 is mounted inside a casing 30 with its water outlet tubes 16 passing through a top panel 36 of casing 30. Nuts and bolts (not shown) pass through brackets 86 on the front and rear of casing 30 and through the tabs 69 and spacers (not shown). Referring to FIGS. 8 and 9, pipe 48 couples an outlet 53 from fan 40 to a T-section of pipe 49. Pipe 49, in turn, connects to pipe 31. Mixing of gas and air takes place in pipe 49. Gas shut-off valve 52 are located between a gas line 42 coupled to a gas supply line (not shown) and a gas pipe 59. Pipe 59 couples to coupling 55 which, in turn, connects to pipe 46. Pipe 46 connects to T-section of pipe 49. Flow sensors 58 monitor the flow of coolant through the tubing of each wall 12 and 13.

At the top of the casing 30, coolant lines 23 and 25 connect to respective outlet tubes 16 of the pulse combustor 10 while coolant lines 27 and 29 connect to respective inlet lines 14. A high limit temperature switch 39 is coupled to a manifold 34. Manifold 34 interconnects coolant lines 23 and 25. A thermocouple 62 is coupled to manifold 34 to measure the temperature of coolant after it has passed through the combustor 10. Flow sensors 56 and 58 are coupled to the inlet to coolant lines 27 and 29, respectively and sense the flow of coolant into coolant lines 27 and 29 from manifold 36. A printed circuit board 50 (see FIG. 10), housed within electrical box 87, is coupled to the fan 40, the ignition rod 32, and various relays and switches and controls the operation of the system. A duct 47 (see FIG. 8) is provided at the center of the rear panel to allow for the exit of combustion products from the casing 30.

Figure 10:
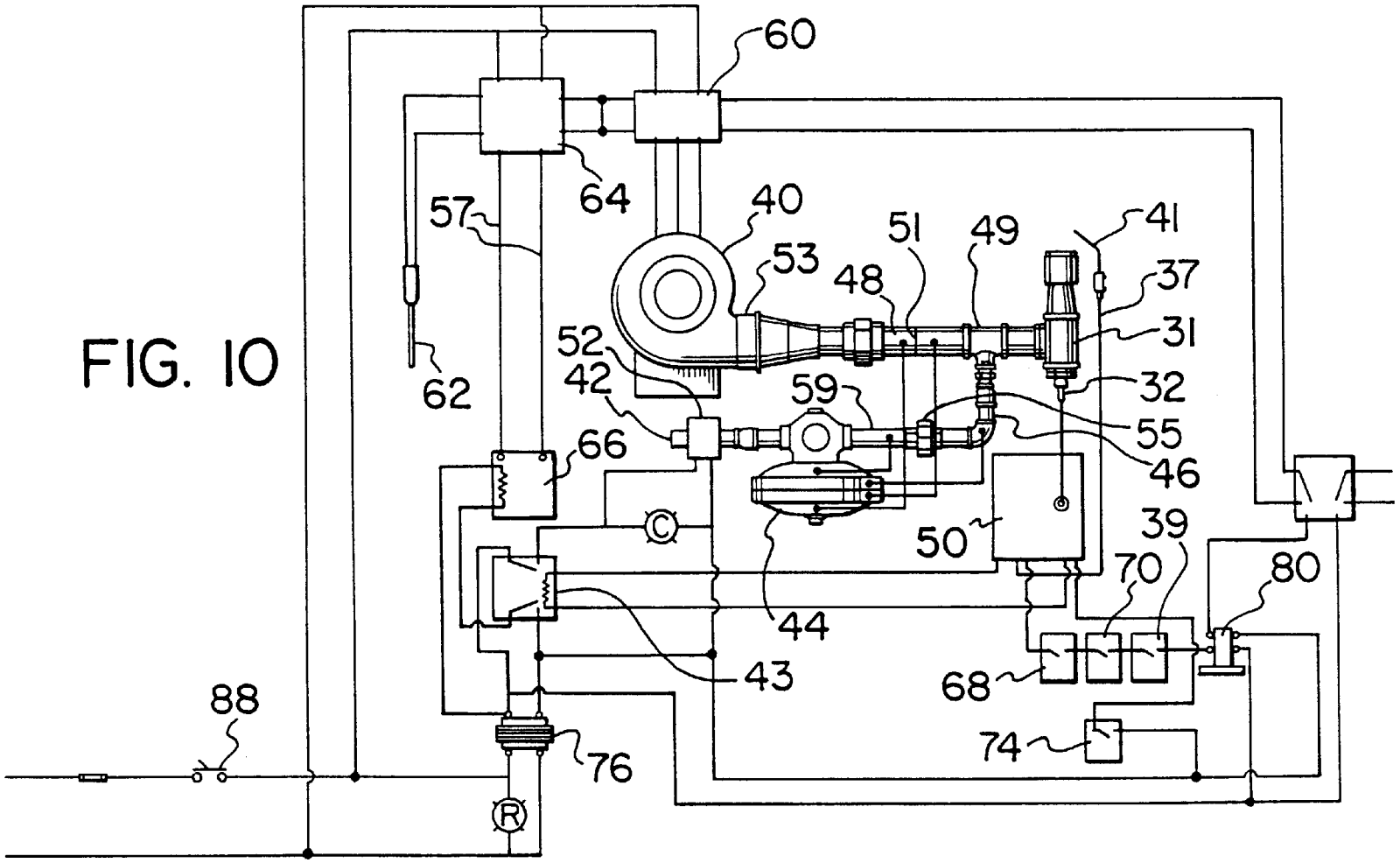
FIG. 10 is a schematic diagram showing the boiler control system.

Referring to FIG. 10, the complete boiler control system includes fan 40 which has an outlet 53 coupled to pipe 48 in which there is located an orifice 51 that enhances the mixing of air with gas. A second orifice in connector 55 located on the gas line 59 connected to the outlet from the gas mass flow regulator 44 causes a build up of pressure in the gas line 59 after which gas enters pipe 46. Pressure is sensed at G1 before the second orifice in connector 55 and G2 after the second orifice. The pressure at the points G1 and G2 is continuously measured and based upon the amount of air and G1–G2, the flow of gas through the regulator is automatically adjusted for the appropriate air/gas ratio in the mixing chamber inside T section 49.

A flame probe 41 is located so that its sensor is inside the combustion chamber 20 and is coupled by wire 37 to controller 50. Flame probe 41 senses the presence of flame in the pulse combustor 10 and sends a signal along wire 37 to advise the controller 50 of this fact.

Controller 50 connects through a water flow switch 70 and a high temperature limit switch 39 to a contact of relay 80. The other terminal of the contact of relay 80 is connected to one output of a transformer 76 coupled to line voltage. The other output terminal of transformer 76 is coupled through thermostat 74 to the controller 50. A speed control 60 is coupled to fan 40, across another contact of relay 80, to an output of a temperature setpoint control 64 and to line voltage. Temperature setpoint control 64 is connected to timer relay 66 and to thermocouple 62 which senses the temperature of outlet coolant from the combustor 10. Transformer 76 steps down line voltage to 24 VAC. The other end of the latter contact of relay 43 connects to the other solenoid terminal of the gas valve 52. One contact of the secondary of transformer 76 connects to timer relay 66 while the other terminal connects directly to relay 43. Thus, when relay 43 is activated and its contacts closed, the output of transformer 76 is applied timer relay 66. Prior to timing out, the output of timer relay 66 as sensed on lines 57 by temperature setpoint control 64 causes the fan 40 to operate on a low flow basis.

Figure 12:
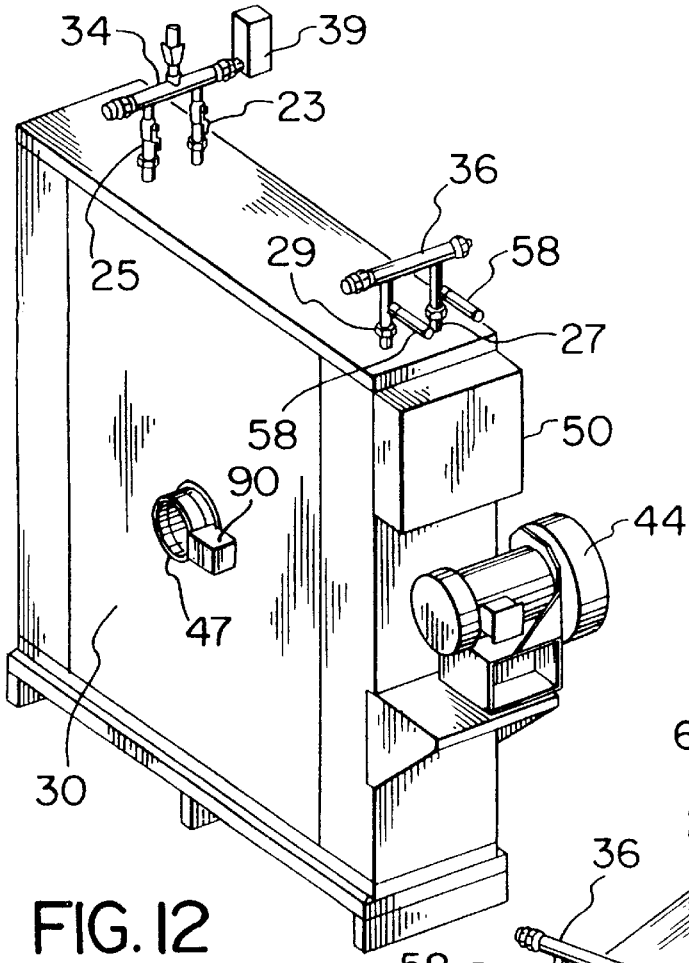
FIG. 12 is a perspective view of an alternate embodiment of the boiler.
Figure 14:
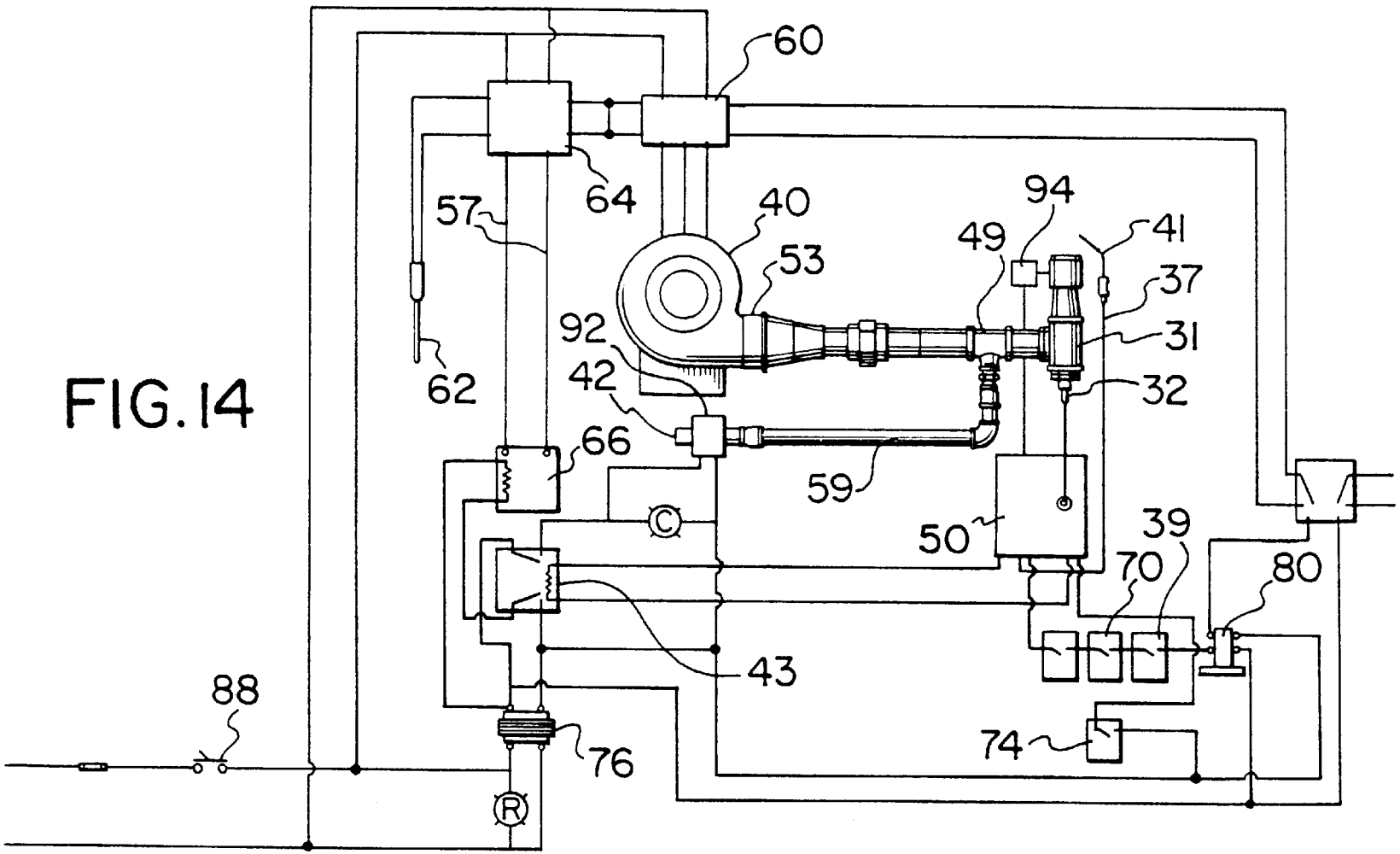
FIG. 14 is a schematic diagram showing the boiler control system.

Referring to FIG. 12, an alternative embodiment of the boiler has an oxygen sensor 90 coupled to duct 47. A zirconia oxygen sensor 90, manufactured by White Rogers, measures the amount of oxygen in the exhaust gases exiting the pulse combustor through duct 47. Referring to FIG. 14, instead of a zirconia oxygen sensor 90 coupled to duct 47, a chemical oxygen sensor 94, manufactured by White Rogers, can be mounted on the gas nozzle receptacle 61 through which the gas and air fuel mixture are supplied to the combustor.

Figure 13:
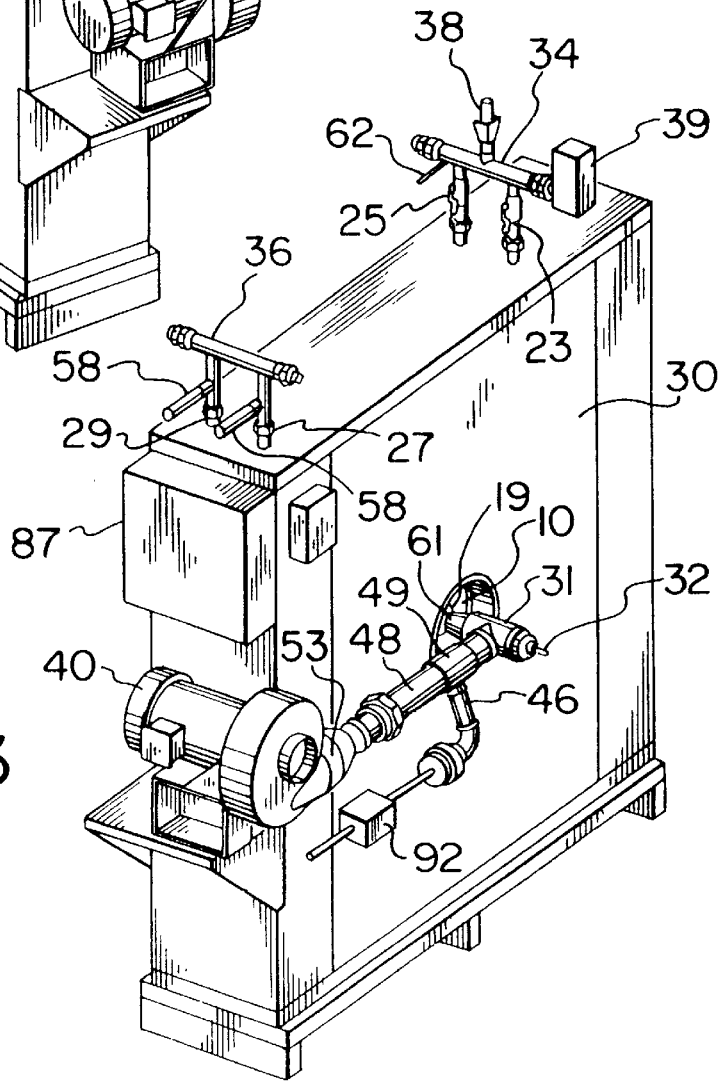
FIG. 13 is a second perspective of the boiler showing the throttle mechanism and the connection into the combustion chamber of the radial pulse combustor.

Referring to FIG. 13, instead of a gas mass regulator 44, a magnetoelectric valve 92 is mounted on gas line 59. The gas flow is automatically adjusted by magnetoelectric valve 92.

Referring to FIG. 14, the boiler control system of the alternative embodiment also includes fan 40 which has an outlet 53 coupled to pipe 94, and a gas line 59. Depending upon the amount of oxygen in the exhaust gases exiting duct 47 as measured by oxygen sensor 90 or the amount of oxygen in the air/gas mixture supplied to pulse combustor as measured by oxygen sensor 94, the flow of gas in pipe 59 is automatically adjusted by magnetoelectric valve 92. Thus, the efficiency of combustion in consuming oxygen is measured directly independently of factors such as temperature and barometric pressure.

Similar to the first embodiment, controller 50 connects through a water flow switch 70 and a high temperature limit switch 39 to a contact of relay 80. The other terminal of the contact of relay 80 is connected to one output of a transformer 76 whose primary coil is coupled to line voltage. The other output terminal of transformer 76 is coupled through thermostat 74 to the controller 50. A speed control 60 is coupled to fan 40, across another contact of relay 80, to an output of a temperature setpoint control 64 and to line voltage. Temperature setpoint control 64 is connected to timer relay 66 and to thermocouple 62 which senses the temperature of outlet coolant from the combustor 10. Transformer 76 steps down line voltage to 24 VAC. The other end of the latter contact of relay 43 connects to magnetoelectric valve 92. One contact of the secondary of transformer 76 connects to timer relay 66 while the other terminal connects directly to relay 43. Thus, when relay 43 is activated and its contacts closed, the output of transformer 76 is applied to timer relay 66. Prior to timing out, the output of timer relay 66 as sensed on lines 57 by temperature setpoint control 64 causes the fan 40 to operate on a low flow basis.

Figure 15:
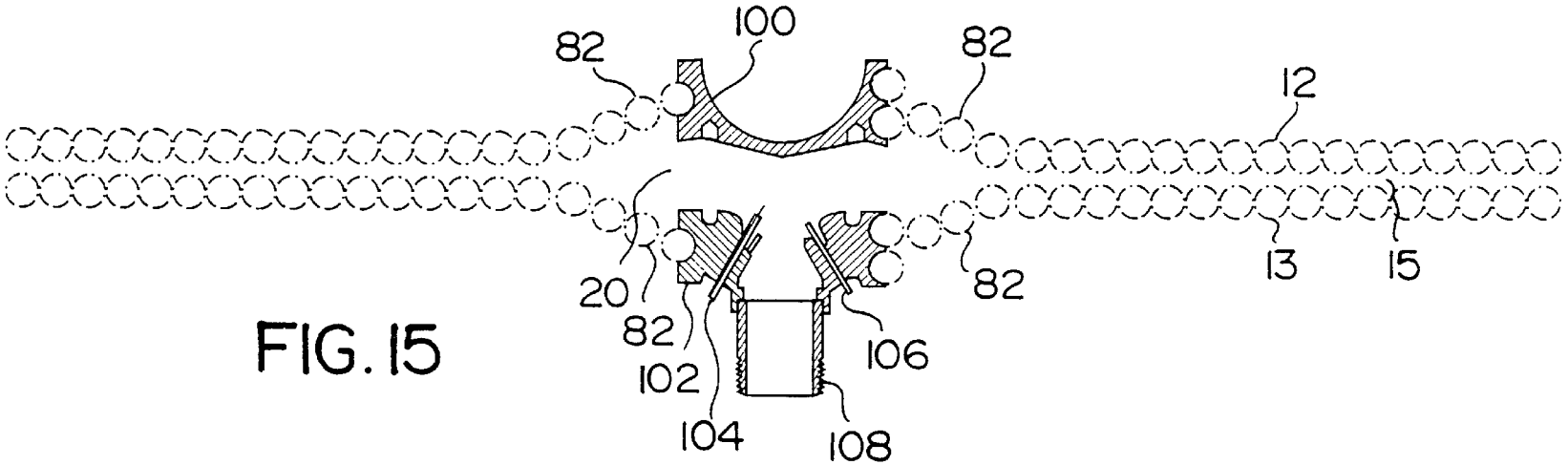
FIG. 15 is an alternative sectional view of the combustor.
Figure 17:
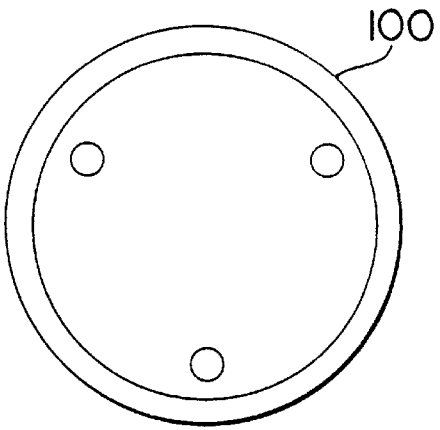
FIG. 17 is a front elevation view of the spreader hub.
Figure 16:
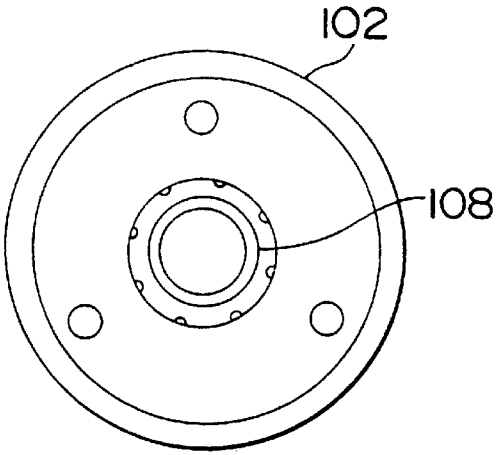
FIG. 16 is a front elevation view of the burner hub.

An alternative design of the combustor 10 is shown in FIGS. 15, 16, and 17 in which a flame spreader 100 made of stainless steel is positioned in the centre of wall 12 opposite a burner hub 102. Burner hub 102 has a central fuel inlet 108, a spark plug 104 and a flame sensor 106. Utilizing an uncooled stainless steel flame spreader avoids the quenching action that would otherwise take place if the coolant tubing extended over the combustion chamber 20.

In operation, an air-gas mixture entering the combustion chamber 20 through the nozzle 19 is ignited by a spark from an end of electrode 33. The resulting explosion of the air/gas mixture causes a sudden rise in the pressure of the combustion chamber 20, thus generating pressure waves which expand radially outward towards the perimeter of the coils. This rapid expansion of the gases, together with cooling by means of heat exchange with the walls 12 and 13 through the flow of water, causes a negative pressure (below atmospheric pressure) inside the combustion chamber 20. At the same time, the pressure waves carrying the combustion products, come to an instantaneous rest at the perimeter of the coils, reverse in direction and travel radially inward, in the form of rarefraction waves, towards the combustion chamber. These rarefraction waves pre-compress the new volume of air and gas; the temperature in the combustion chamber 20 still being high, the new air/gas volume is combusted without the need for ignition from the electrode 33, and the process is repeated.

On start-up water flow into each of the tubes of walls 12 and 13 is initiated by first closing shut off valve 22 and opening shut off valve 22*a* so that coolant is forced to travel through one wall of walls 12 and 13 only, and then opening valve 22 to force coolant through the other of walls 12 and 13. This procedure ensures that there is flow in each wall of the combustor 10.

Once water is flowing, the power switch 88 is turned on. Thermostat 74 will then call for heat. Terminals 4 and 5 on the sequencer 80 will close and the fan 40 will start. After 45 seconds terminals 1 and 3 on the sequencer 80 close and 24 volts is supplied to the ignition controller 50 through the high temperature limit switch 39, the water flow switch 70, and the air differential switch 68. The water flow switch 70 is normally open. As soon as water flows through both coils it closes. Similarly, the air differential switch is normally open but as soon as the fan 40 comes on, the air differential switch closes. The high temperature limit switch is normally closed. As soon as the water temperature rises above that set by the end user, this switch opens and terminates the combustion thereby shutting down the boiler.

The ignition controller 50 sends 25,000 volts to the electrode 33 and 24 volts to the solenoid valve 52 through relay 43 which turns on the gas flow at the same time as the electrode 33 is energized. Gas flows to the mass flow regulator 44 through the now open solenoid valve 52 in the first embodiment. From the regulator 44, gas flows into the mixing chamber inside T-section 49. In the second embodiment, the gas flows to the T-section 49 through the now open magnetoelectric valve 92. The air-gas mixture enters the nozzle 19 and combustion chamber 20 where combustion takes place. Upon ignition, the spark will be stopped 2 seconds after the flame is sensed by the flame sensor 41. Signals from the flame sensor 41 are sent to the ignition controller 50 and the solenoid valve 52 in the first embodiment which remains open as long as these signals are received. In the second embodiment, signals from the flame sensor 41 are sent to the ignition controller 50 and magnetoelectric valve 92 which remains open as long as these signals are received.

At the start of each operation, the timer 66 relay will be at set point corresponding to a frequency of 40 Hz applied to the fan 40. After 30 seconds the set point will move to that corresponding to a frequency of 65 Hz. When the ignition controller 50 is energized the following sequence of events takes place. Terminals 3 and 5 and 6 and 4 on relay 43 close, thus applying power to the timer relay 66. For the first 30 seconds, the timer relay 66 will be at set point 40 Hz after which it moves to 65 Hz. Thermocouple 62 continuously measures the water temperature at the boiler outlet and these signals are sent to controller 64. If the temperature measured by thermocouple 62 is below that of controller 64, corresponding signals are sent to the speed controller 60 which controls the fan speed. The fan 40 operates at a high speed. If the temperature measured by thermocouple 62 approaches that measured by the temperature setpoint control 64, corresponding signals are sent to the speed control 60 and the fan will speed will reduce correspondingly.

In the first embodiment, through sensing the A1-A2/G1-G2 ratio, a drop in Al-A2 results in the gas mass regulator reducing the gas flow in the first embodiment. A reduction in gas flow causes a reduction in G1-G2 so the ratio A1-A2/G1-G2 remains constant. In the second embodiment, a decrease in the amount of oxygen supplied as sensed by oxygen sensor 94 or an increase in the amount of oxygen in the exhaust gases as sensed by oxygen sensor 90 results in magnetoelectric valve 92 adjusting the flow of gas so that the ratio of the amount of oxygen to amount of gas remains constant. Thus both throttle systems allow for optimum continuous operation of the boiler, significantly reducing the on/off cycles.

Should the spark fail to ignite the pulse combustor 10 as detected by the flame probe 41 within 5 seconds, the entire system is shut down with the gas valve 52 closing and the sensors being deactivated.

One example of a use for the present boiler system is to supply hot water to a hot water tank. The thermostat 74 would be used to measure the temperature of the water in the tank (not shown). Once the temperature of water in the tank fell below a preset limit, the thermostat 74 would close and the system would initiate startup and then full operation. Thermocouple 62 would sense the temperature of the water being supplied to the tank by the boiler system. The boiler system would then supply water at the temperature established by the temperature setpoint control 64.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

I claim:

1. A boiler comprising:

a) a combustor for combusting an air-gas fuel mixture and exchanging the heat of combustion therefrom with a heat exchange fluid; said combustor comprising a pair of spaced apart walls so shaped as to define a combustion chamber therebetween, each said wall being formed of a continuous hollow tube wound in a substantially concentric spiral, said walls being attached to each other in a manner so as to form said combustion chamber proximal the center of said spiral of each said wall, and each said hollow tube having an inlet end and an outlet end thereby to form a fluid passageway therebetween;

b) an air gas fuel mixture nozzle and an ignition rod, each located proximal said combustion chamber;

c) an air line for providing a flow of air to said combustion chamber;

d) a gas line in flow communication with said air line for providing gas fuel to said combustion chamber in admixture with said air;

e) means for measuring a property of the mixture of air and gas fuel, which property is characteristic of said mixtures combustibility and for sending a signal representative of the measurement taken;

f) means for receiving said signal from said means for measuring a property of the mixture of air and gas fuel and for controlling the air to gas fuel ratio in response thereto;

g) means for sensing the temperature of a fluid exiting said hollow tube and for sending a signal representative of said temperature; and h) air flow control means for receiving said signal from said means for sensing the temperature of a fluid exiting said hollow tube and for controlling the flow of air through said air line in response thereto.

2. A boiler according to claim 1, wherein said means for measuring is an oxygen sensor.

3. A boiler according to claim 2, wherein said oxygen sensor is located to measure the combustion gases after combustion of said gas fuel/air mixture.

4. A boiler according to claim 2, wherein said oxygen sensor is located proximate an input to said combustor to measure the oxygen in said air/gas fuel mixture immediately before combustion.

5. A boiler according to claim 1, wherein said valve is a magnetoelectric valve operative to control the flow rate of gas in said gas line in response to a control signal from said oxygen sensor.

6. A boiler according to claim 1, wherein said means for sensing temperature is a thermocouple in the coolant flow exiting said heat exchanger.

7. A boiler according to claim 1, further comprising a furl line coupling mechanism at an inlet of said combustion chamber operative to couple to a fuel line and supply premixed fuel from said boiler.

8. A boiler according to claim 7, including a burner hub at an inlet to said combustor having a central fuel inlet.

9. A boiler according to claim 7, including a spark plug having a spark end communicating with said combustion chamber.

10. A boiler according to claim 7, wherein the heat exchange fluid enters said tubing of said spaced apart walls at a periphery of said walls and exits from hollow tubing leaving proximate said combustion chamber of said combustor.

11. A boiler according to claim 7, wherein windings of said hollow tubing are welded together so gas cannot leak out of the tail pipe region of said combustor.

12. A boiler according to claim 7, wherein said inlet has a nozzle with a plurality of fuel passageways radially spaced around an axis of said nozzle for conducting fuel into said combustion chamber.

13. A boiler comprising:

a) a combustor for combusting an air-gas fluid mixture having a heat exchanger which conducts coolant, wherein said combustor is a type having a pair of disc-shaped spaced apart walls enclosing a central combustion chamber and an exhaust region between said walls which surrounds said combustion chamber and extends outwardly from said combustion chamber, said first and second spaced apart walls each formed of hollow tubing wound in a spiral from said combustion chamber outwardly towards said exhaust region with windings of said spiral being adjacent and contiguous;

b) a fan coupled to an air line operative to provide a flow rate of air in the air line and a speed control unit coupled to said fan to control the flow of air through said air line;

c) a gas line coupled at one end to a source of gas and at another end to said air line so as to prodeuce a mixture of gas and air;

d) means for measuring a property of the air-gas fuel mixture characteristic of its combustibility;

e) a valve coupled to said gas line and operative to control a flow rate of gas in response to a control signal from said means for measuring; and f) a temperature sensor for taking a temperature measurement of the coolant after passing through said heat exchanger and transmitting the temperature measurement to said speed control unit, wherein said tubing of each of said walls is adapted to conduct a heat exchange coolant, and wherein said speed control unit slows down the speed of said fan when the coolant temperature approaches a preset limit; and further including a fuel line coupling mechanism at an inlet of said combustion chamber operative to couple to a fuel line and supply premixed fuel from said boiler;

wherein said combustor has a flame spreader hub on a side of said combustion chamber opposite an inlet thereto to prevent quenching of combustion in said combustion chambet.

14. A boiler comprising:

a) a combustor for combusting an air-gas fuel mixture having a heat exchanger which conducts a coolant, wherein said combustor is a type having a pair of disc-shaped spaced apart walls enclosing a central combustion chamber and an exhaust region between said walls which surrounds said combustion chamber and extends outwardly from said combustion chamber, said first and second spaced apart walls each formed of hollow tubing wound in a spiral from said combustion chamber outwardly towards said exhaust region with windings of said spiral being adjacent and contiguous;

b) a fan coupled to an air line operative to provide a flow rate of air in the air line and a speed control unit coupled to said fan to control the flow of air through said air line;

c) a gas line coupled at one end to a source of gas at another end to said air line so as to produce a mixture of gas and air;

d) means for measuring a property of the air-gas fuel mixture characteristic of its combustibility;

e) a valve coupled to said gas line and operative to control a flow rate of gas in response to a control signal from said means for measuring; and f) a temperature sensor for taking a temperature measurement of the coolant after passing through said heat exchanger and transmitting the temperature measurement to said speed control unit, wherein, said tubing of each of said walls in adapted to conduct a heat exchange coolant; and wherein said speed control unit slows down the speed of said fan when the coolant temperature approaches a preset limit; and further including:

a fuel line coupling mechanism at an inlet of said combustion chamber operative to couple to a fuel line and supply premixed fuel from said boiler;

a burner hub at said inlet to said combuster having a cental fuel inlet; and a flame sensor inserted through said burner hub into said combustion chamber.

15. A boiler comprising:

a) a combustor for combusting an air-gas fuel mixture having a heat exchanger which conducts a coolant, wherein said combustor is a type having a pair of disc-shaped spaced apart walls enclosing a central combustion chamber and an exhaust region between said walls which surrounds said combustion chamber and extends outwardly from said combustion chamber, said first and second spaced apart walls each formed of hollow tubing wound in a spiral from said combustion chamber outwardly towards said exhaust region with windings of said spiral being adjacent and contiguous;

b) a fan coupled to an air line operative to provide a flow rate of air in the air line and a speed control unit coupled to said fan to control the flow of air through said air line;

c) a gas line coupled at one end to a source of gas at another end to said air line so as to produce a mixture of gas and air;

d) means for measuring a property of the air-gas fuel mixture characteristic of its combustibility;

e) a valve coupled to said gas line and operative to control a flow rate of gas in response to a control signal from said means for measuring; and f) a temperature sensor for taking a temperature measurement of the coolant after passing through said heat exchanger and transmitting the temperature measurement to said speed control unit, g) a fuel line coupling mechanism at an inlet of said combustion chamber operative to couple to a fuel line and supply premixed fuel from said boiler;

wherein said tubing of each of said walls is adapted to conduct a heat exchange coolant, and wherein a spark plug passes through an opening through a burner nozzle to one side of the fuel inlet.

16. A boiler comprising:

a) a combustor for combusting an air-gas fuel mixture having a heat exchanger which conducts a coolant, wherein said combustor is a type having a pair of disc-shaped spaced apart walls enclosing a central combustion chamber and an exhaust region between said walls which surrounds said combustion chamber and extends outwardly from said combustion chamber, said first and second spaced apart walls each formed of hollow tubing wound in a spiral from said combustion chamber outwardly towards said exhaust region with windings of said spiral being adjacent and contiguous;

b) a fan coupled to an air line operative to provide a flow rate of air in the air line and a speed control unit coupled to said fan to control the flow of air through said air line;

c) a gas line coupled at one end to a source of gas at another end to said air line so as to produce a mixture of gas and air;

d) means for measuring a property of the air-gas fuel mixture characteristic of its combustibility;

e) a valve coupled to said gas line and operative to control a flow rate of gas in response to a control signal from said means for measuring; and f) a temperature sensor for taking a temperature measurement of the coolant after passing through said heat exchanger and transmitting the temperature measurement to said speed control unit, wherein said tubing of each of said walls is adapted to conduct a heat exchange coolant, and wherein said speed control unit slows down the speed of said fan when the coolant temperature approaches a preset limit; and further including a fuel line coupling mechanism at an inlet of said combustion chamber operative to couple to a fuel line and supply premixed fuel from said boiler;

wherein said combustor has a flame spreader hub on a side of said combustion chamber opposite an inlet thereto to prevent quenching of combustion in said combustion chamber, and;

wherein said flame spreader hub has a conical surface facing said nozzle in order to disperse a flame outwardly through said combustor.

* * * * *